US011200831B2

(12) United States Patent
Pappas et al.

(10) Patent No.: US 11,200,831 B2
(45) Date of Patent: Dec. 14, 2021

(54) DISPLAY USING ANALOG AND DIGITAL SUBFRAMES

(71) Applicant: Facebook Technologies, LLC, Menlo Park, CA (US)

(72) Inventors: Ilias Pappas, Cork (IE); Sean Lord, Ottawa (CA); Yu-Hsuan Li, Hsinchu (TW); Alexander Victor Henzen, Bladel (NL)

(73) Assignee: Facebook Technologies, LLC, Menlo Park, CA (US)

( * ) Notice: Subject to any disclaimer, the term of this patent is extended or adjusted under 35 U.S.C. 154(b) by 460 days.

(21) Appl. No.: 15/458,832

(22) Filed: Mar. 14, 2017

(65) Prior Publication Data

US 2017/0270850 A1 Sep. 21, 2017

(30) Foreign Application Priority Data

Mar. 21, 2016 (GB) ..... 1604699

(51) Int. Cl.
*G09G 3/20* (2006.01)
*G09G 3/3225* (2016.01)
*G09G 3/32* (2016.01)

(52) U.S. Cl.
CPC ..... *G09G 3/2092* (2013.01); *G09G 3/2011* (2013.01); *G09G 3/2022* (2013.01);
(Continued)

(58) Field of Classification Search
CPC ..... G09G 2310/02; G09G 2310/0213; G09G 2310/0243; G09G 2310/0259;
(Continued)

(56) References Cited

U.S. PATENT DOCUMENTS 5,748,160 A * 5/1998 Shieh ..... G09G 3/2011 345/210
5,990,629 A 11/1999 Yamada et al.
(Continued)

FOREIGN PATENT DOCUMENTS

EP 1187087 A1 3/2002
KR 2005-0122688 A 12/2005
(Continued)

OTHER PUBLICATIONS

UK Combined Search and Examination Report Under Sections 17 and 18(3), Application No. GB1604699.7, dated Apr. 26, 2016, 13 pages.
(Continued)

*Primary Examiner* — Roberto W Flores
(74) *Attorney, Agent, or Firm* — Fenwick & West LLP

(57) ABSTRACT

A display comprises a matrix comprising a plurality of N rows divided into a plurality of M columns of cells, each cell including a light emitting device; a scan driver providing a plurality of N scan line signals to respective rows of said matrix, each for selecting a respective row of the matrix to be programmed with pixel values; and a data driver providing a plurality of M variable level data signals to respective columns of the matrix, each for programming a respective pixel within a selected row of the matrix with a pixel value. A pulse driver provides a plurality of N driving signals to respective rows of the matrix, each driving signal comprising successive sequences of pulses enabling the cells to emit light according to their programmed pixel values during respective sub-frames of successive frames to be displayed. The data driver is arranged to provide variable level data signals to respective pixels within a selected row of the matrix during a limited number of sub-frames of a frame, the variable data levels corresponding to a programmed value of a plurality of bits of a pixel value for a frame. The data driver
(Continued)

is further arranged to provide data signals to respective pixels within a selected row of the matrix during a remaining number of sub-frames of a frame, the data signals each corresponding to a programmed value of a single bit of a pixel value for a frame.

18 Claims, 8 Drawing Sheets

(52) U.S. Cl.
CPC ..... *G09G 3/2077* (2013.01); *G09G 3/32* (2013.01); *G09G 3/3225* (2013.01); *G09G 2300/0842* (2013.01); *G09G 2300/0866* (2013.01); *G09G 2310/08* (2013.01); *G09G 2320/0247* (2013.01)

(58) Field of Classification Search
CPC ..... G09G 2310/027; G09G 2310/06; G09G 2310/08; G09G 2320/0247; G09G 2320/0257; G09G 2320/0266; G09G 2320/04; G09G 2320/0633–0653; G09G 2310/0257; G09G 2310/0266; G09G 2310/04; G09G 2330/021; G09G 3/14; G09G 3/32; G09G 3/2007–204; G09G 3/2077; G09G 3/2092; G09G 3/2081; G09G 3/3067
See application file for complete search history.

(56) References Cited

U.S. PATENT DOCUMENTS

| | | | | |
|---|---|---|---|---|
| 6,753,854 | B1 * | 6/2004 | Koyama | G09G 3/3291 345/106 |
| 2004/0021626 | A1 | 2/2004 | Shimizu | |
| 2005/0024309 | A1 | 2/2005 | Yamazaki et al. | |
| 2006/0181490 | A1 * | 8/2006 | Ozaki | G09G 3/2022 345/76 |
| 2008/0122873 | A1 * | 5/2008 | Hong | G09G 3/2022 345/690 |
| 2011/0001733 | A1 * | 1/2011 | Kawabe | G09G 3/2022 345/204 |
| 2013/0141469 | A1 | 6/2013 | Xu | |
| 2015/0015616 | A1 * | 1/2015 | Buckley | G09G 3/30 345/690 |
| 2015/0062198 | A1 * | 3/2015 | Shin | G09G 3/2025 345/690 |
| 2017/0213526 | A1 * | 7/2017 | Hara | G09G 5/395 |

FOREIGN PATENT DOCUMENTS

| | | | |
|---|---|---|---|
| KR | 10-0672963 | B | 1/2007 |
| WO | WO 2005/104074 | A1 | 11/2005 |
| WO | WO 2009/082056 | A1 | 7/2009 |
| WO | WO 2013/121051 | A1 | 8/2013 |

OTHER PUBLICATIONS

UK Further Search/Combined Search and Examination Report Under Sections 17 and 18(3), Application No. GB1604699.7, dated Jun. 6, 2016, 7 pages.

* cited by examiner

DISPLAY USING ANALOG AND DIGITAL SUBFRAMES

CROSS REFERENCE TO RELATED APPLICATIONS

This application claims the benefit of United Kingdom Application No. 1604699.7, filed Mar. 21, 2016, which is incorporated by reference in its entirety.

FIELD

The present invention relates to a display and a method of driving a display.

BACKGROUND

Displays are ubiquitous and are a core component of every wearable device, smart phone, tablet, laptop, desktop, TV or display system. Common display technologies today range from Liquid Crystal Displays (LCDs) to more recent Organic Light Emitting Diode (OLED) displays. The type of displays are distinguished by the way light is either controlled or emitted. In some cases, there is a light control element, like liquid crystal molecules or a MEMs device, that acts as a light switch which is controlled by current or voltage, whereas in other cases, there is a light emitting device, such as an LED that emits light when it is biased by current or voltage.

WO2013/121051 discloses an improved light emitting device, referred to as an integrated or inorganic LED (iLED) which comprises a substrate with a semiconductor material comprising a light generating layer positioned on the substrate. The semiconductor material and/or the substrate are configured to control light internally to output quasi-collimated light from a light emitting surface of the iLED. The iLED comprises an optical component positioned at the light emitting surface and configured to receive quasi-collimated light exiting the light emitting surface and to alter one or more optical properties of at least some of the quasi-collimated light.

For any display, regardless of its particular light emitting device, the smallest light element of the display is referred to as a pixel and these are typically arranged in a matrix of rows and columns. In order to produce images, display pixels have to be programmed for predetermined time periods called frames. The most common way of programming a display is the row-by-row method. Here, every row of pixels is addressed sequentially and the pixels of the row are simultaneously programmed in parallel.

Display addressing circuitry can comprise either passive or active matrix. Active matrix circuitry, for example, as described in WO2010/119113, uses thin film transistor technology (TFT), where transistors based on amorphous, oxide or polycrystalline silicon technology are manufactured on glass panels of different dimensions and are used either as voltage switches or current sources to control the operation of light emitting devices. Passive matrix circuitry implies that addressing signals are delivered directly to the light emitting devices without any other control.

Initially, both active and passive addressing matrices used an analog approach where a pixel's brightness was based on the level of the applied bias voltage or the current. For example, if an 8-bit gray-scale were being employed, pixels would be biased with one or 256 different voltage or current values during a frame. The analog approach is solid and accurate, however, increased performance demands have led to move from the analog approach to a digital one.

According to the digital approach, pixel brightness is no longer controlled by the voltage/current level, but according to the time duration of light emitted from a pixel. Thus, a frame is divided into a specific number of time slots called sub-frames. During any given sub-frame, a pixel is either switched ON (and emitting light) or OFF. Referring to FIG. 1, if for example, 8-bit gray-scale is desired, each frame is divided into 8 sub-frames, each with a different time duration. The sub-frame with the longest duration represents the Most Significant Bit (MSB) and the sub-frame with the shortest duration represents the Least Significant Bit (LSB) of a pixel value for the frame. Therefore, instead of programming the brightness by the bias voltage/current level, brightness is controlled by the integral of the ON pulse duration during a sub-frame. The advantage of using the digital approach is that the ON voltage/current level remains the same for all frames and sub-frames and can be set to the optimum operating value for the light emitting device, whereas using the analog approach requires light emitting devices which can perform across a range of operating values.

The most common digital driving methods are Pulse Width Modulation (PWM), for example, as described in WO2010/014991, and colour sequential, for example, as described in WO2014/012247. The difference between PWM and color sequential is that in the case of the PWM, all 3 colors (red, green, blue) of light emitting devices emit light simultaneously during one sub-frame while for color sequential, each sub-frame is further divided into red, green and blue periods meaning that for a given sub-frame duration only red light emitting devices over the whole panel emit light, then only green and finally only blue light emitting devices. So whereas one approach to implementing PWM is for rows of a matrix to comprise a mix of red, green and blue pixels and for these to be simultaneously activated when programmed; whereas for colour sequential, each row of a matrix might only comprise either red, green or blue sub-pixels. The difference results in the colour sequential scheme requiring at least three times the switching frequency than for PWM, since during the same sub-frame, it has to switch three times, once for each colour.

Both digital driving methods suffer from different visual artefacts caused by the switching of emitted light, the most common one being termed 'flicker noise'. In some cases, special driving algorithms can be used to mitigate these problems, but in general it is preferable to increase the frequency of the digital driving pulses so that the switching cannot be observed by a viewer.

However, the pulse frequency is limited by the pixel circuit design and its propagation delay. As the complexity of the pixel design increases, more components can result in higher propagation delays for the digital pulses since the pulses have to charge and discharge or activate more components.

Typically frames are refreshed at frequencies of at least 50-60 Hz, but in the future for high performance displays this could increase to 600 Hz and beyond, reducing frame time significantly and so increasing the switching demands for display addressing circuitry. Thus, as performance demands for displays increase, for example, to allow for increased frame refresh rate, optimization of addressing methods becomes a necessity.

SUMMARY

According to a first aspect, the present invention provides a display according to claim 1.

In embodiments, analog and digital sub-frames are employed to determine pixel brightness during a frame. Here, an analog approach is employed for the Least Significant Bits (LSB) and a digital approach for the Most Significant Bits (MSB).

It is appreciated that switching some light emitting devices using on/off pulses can increase the performance demand on the device and cause failure or it can lead to unwanted visible artefacts. In some embodiments, rather than an on/off pulse, a stepped waveform with multiple intermedia voltage levels is applied to pixels, during both analog and/or digital sub-frames, both to reduce power and to smooth transition from the perspective of a viewer.

Some embodiments comprise an active matrix of inorganic LED (iLED) devices.

In some embodiments, control pulses are applied directly to the light emitting device and in some cases applied directly from a driver to the light emitting devices.

Some embodiments operate by applying a control pulse at the cathode of the light emitting device instead at a high power supply side of a pixel.

According to a second aspect, the present invention provides a display according to claim 17.

BRIEF DESCRIPTION OF THE DRAWINGS

Various embodiments of the present invention will now be described, by way of example, with reference to the accompanying drawings, in which.

DESCRIPTION OF THE EMBODIMENTS

Figure 4:
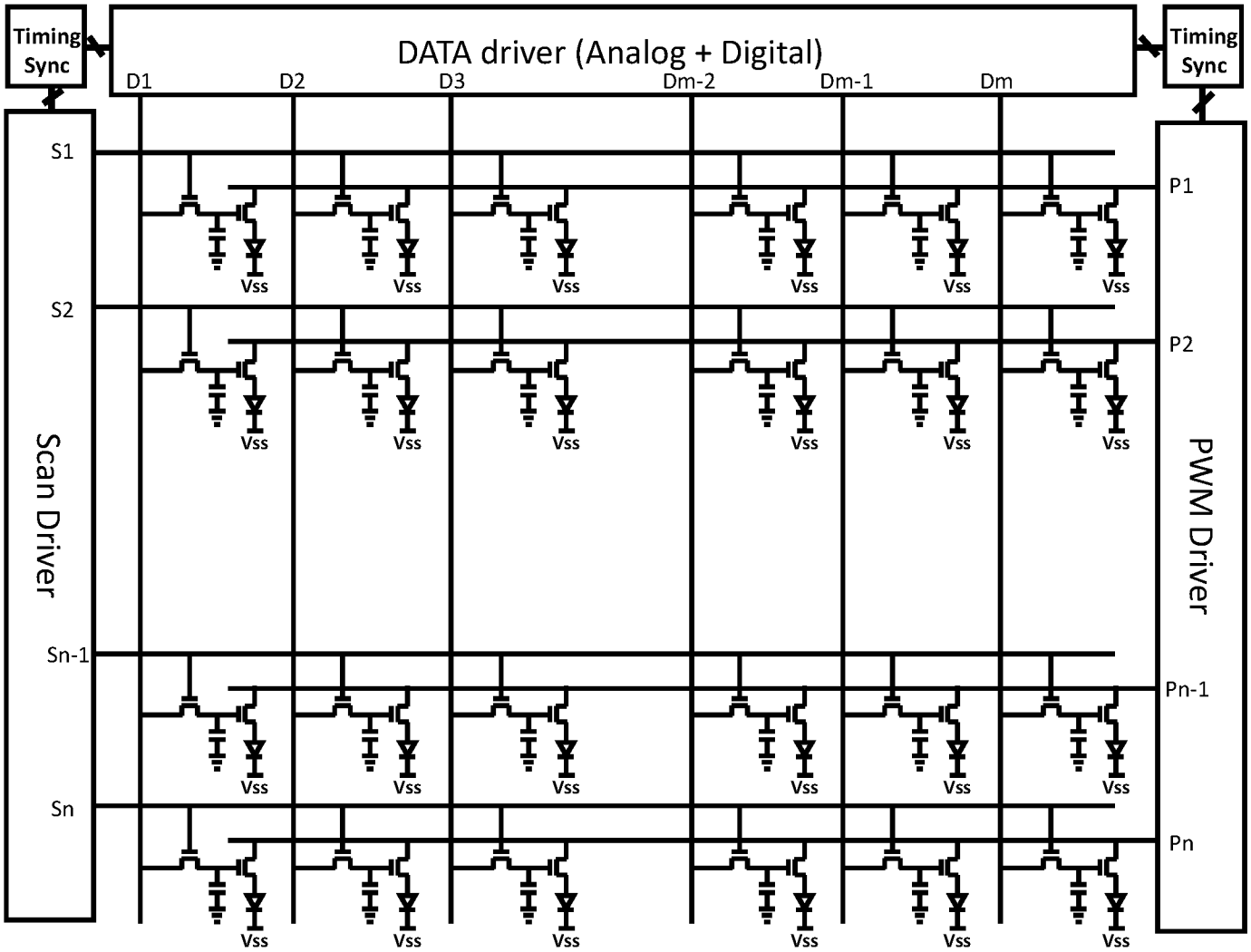
FIG. 4 shows an active drive matrix for a display according to one embodiment of the present invention.
Figure 5:
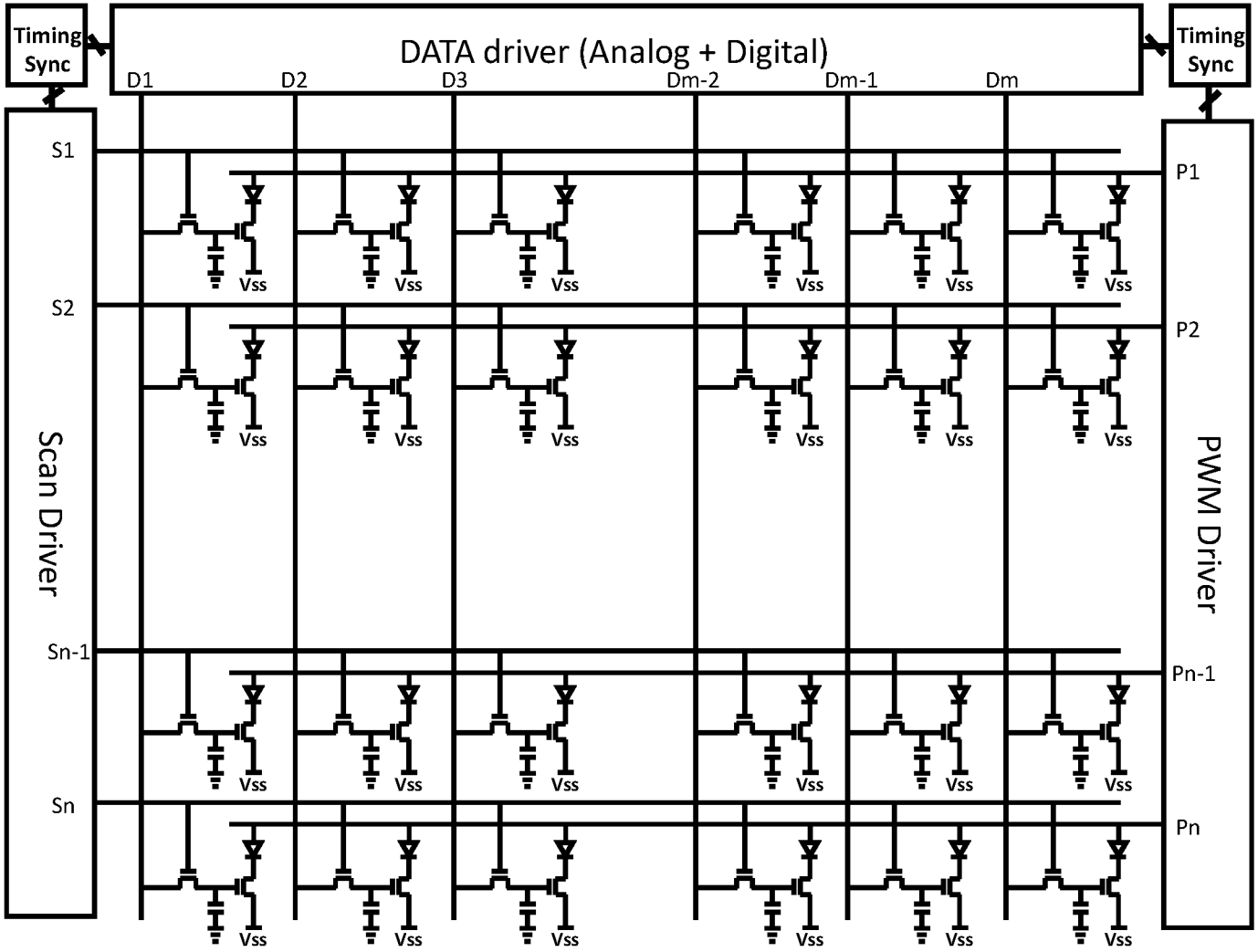
FIG. 5 shows an active drive matrix for a display according to another embodiment of the present invention.
Figure 6:
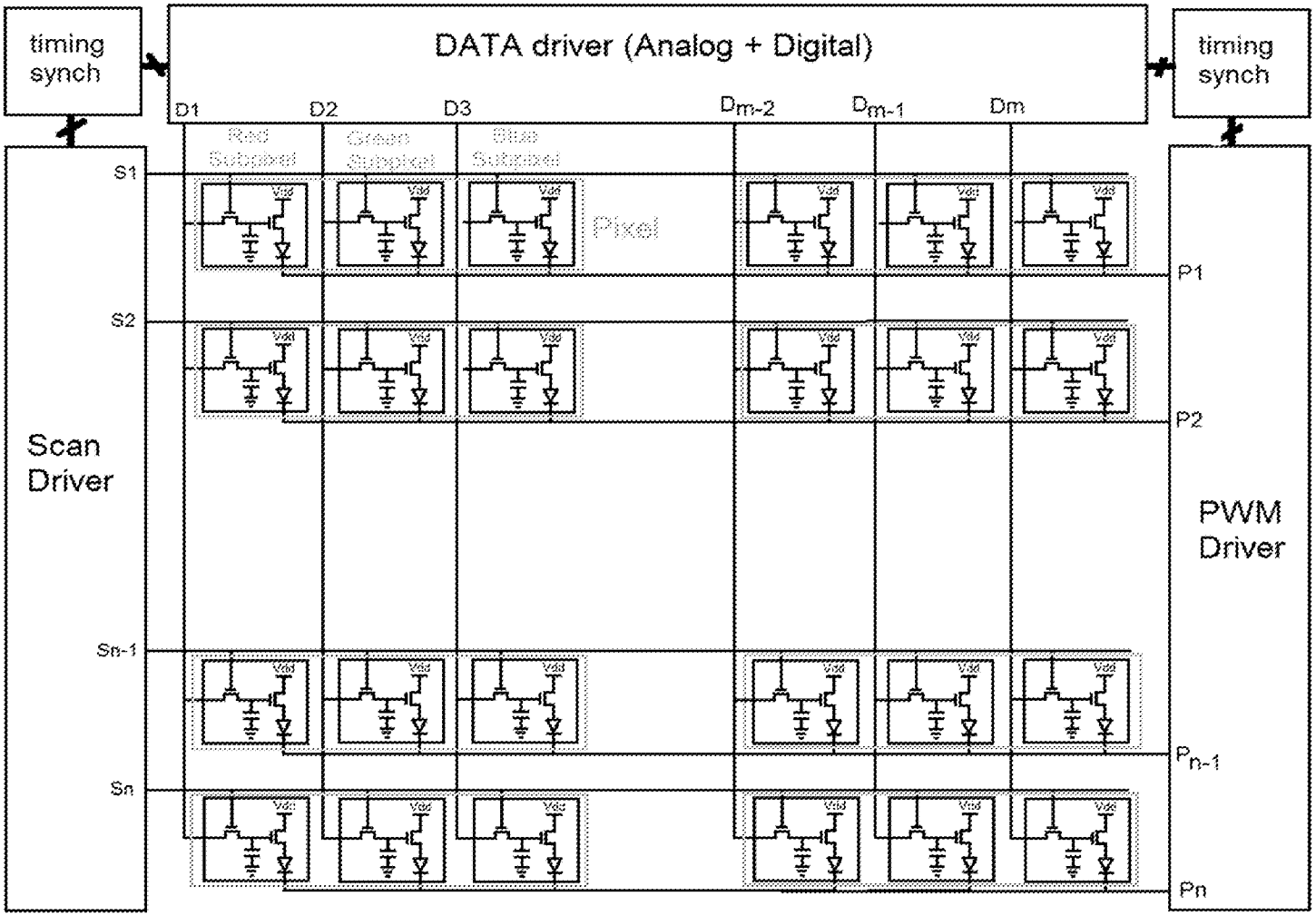
FIG. 6 shows an active drive matrix for a display according to a still further embodiment of the present invention.

Referring now to FIGS. 4, 5 and 6, there are shown exemplary active drive matrices for a display according to embodiments of the present invention. Each matrix comprises N rows of cells divided into M columns. Each cell corresponds to either: a pixel for a monochrome display; or one of a red, green or blue sub-pixel within a color display. As explained, for color displays either: differently colored sub-pixels can be interleaved along rows of the matrix; or respective rows of the matrix can comprise only sub-pixels of a given colour.

A plurality of peripheral driving blocks comprise:

Scan driver—which produces the pulses enabling respective rows of the matrix to be programmed for a subsequent sub-frame;

DATA driver—which delivers both variable level outputs to program individuals cells of a row enabled by the scan driver; and PWM Driver—which produces the PWM pulses used to bias programmed cells enabling the cells to emit light or not according to their programming. (Note that the term "PWM" is used in the present description to relate to pulsed signals for activating cells within a row—such pulses may be employed as part of a conventional PWM addressing scheme or a color sequential scheme.)

Two synchronization blocks are employed: one located between the scan driver and DATA driver in order to ensure that the required data signals are delivered after a scan pulse is applied to a row; and a second between the DATA and PWM drivers to ensure that PWM pulses are applied when data loading is completed.

Each row within the matrix is addressed with a respective scan line S1 . . . Sn which goes high or is asserted when a respective row of the display is to be addressed (or programmed) by the DATA driver for the subsequent sub-frame. During a given frame for each row, the PWM driver provides a sequence of driving pulses using respective PWM signals P1 . . . Pn. Each signal P can be a time shifted version of the adjacent PWM signal synchronized with the scan line signals S1 . . . Sn and DATA driver signals D1 . . . Dm.

In embodiments of the present invention, the DATA driver provides programming signals D1 . . . Dm for each pixel of the display—these signals are updated for each sub-frame from scan line to scan line.

Figure 7B:
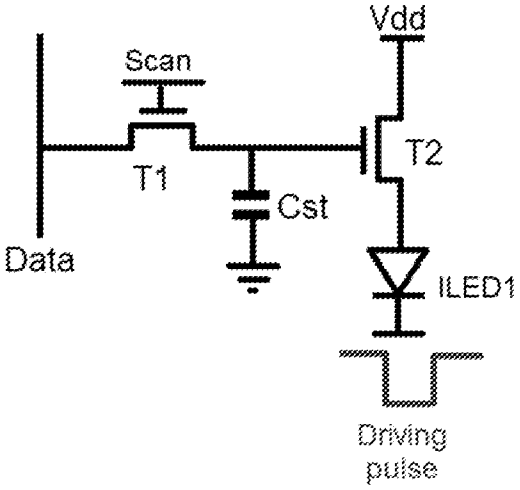
FIGS. 7(*a*) and 7(*b*) illustrate the driving pulses for the matrices of FIGS. 4, 5 and FIG. 6 respectively.
Figure 7A:
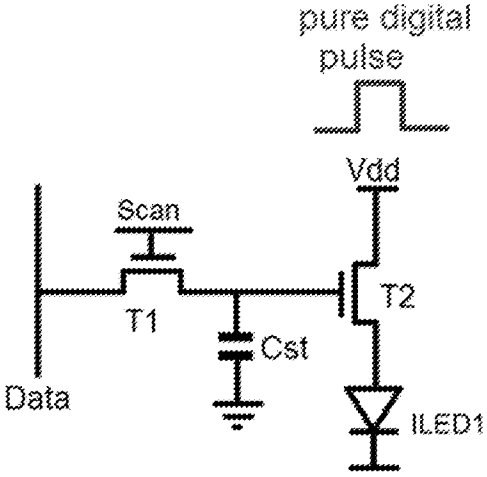

Referring briefly to FIGS. 7(*a*) and 7(*b*), in a 2-transistor, 1-capacitor (2T1C) pixel design, such as employed in the matrices of FIGS. 4, 5, 6, each pixel comprises a light emitting device, for example, an iLED such as disclosed in WO2013/121051, connected in series with a thin-film transistor T2. FIG. 7(*a*) illustrates the pixel design for the matrix of FIG. 4 where the iLED is connected between the transistor drain and ground (Vss); whereas in the pixel design of FIG. 5, the iLED is connected directly between the PWM signal line and the transistor source.

In each case, the scan line for the row and the data line for the cell are connected to a thin-film transistor T1. When a given row is selected by asserting the associated scan line signal, T1 is switched on and the data line signal is used either to charge or discharge a charge storage capacitor Cst shunt-connected between T1 and the gate of the transistor T2 to program a required charge for the subsequent sub-frame. In some embodiments, such as FIG. 7(*a*), a PWM signal can be applied at the source side of T2 and according to the charge on Cst, the iLED will emit light or not for the sub-frame.

Conventionally, the values for each data signal D1 . . . Dm are digital in that they are either high or low, ("0" or "1", asserted or not) switching on a pixel for a subsequent sub-frame when the scan line signal S and the PWM signal P for a pixel are asserted and the value for D is high and switching off the pixel, if during the same period, the value for D is low.

In some embodiments of the present invention, a digital driving method is combined with an analog approach not alone to potentially reduce the time required for a frame, but also to reduce the maximum switching frequency required to program pixels for a frame. In this case, values for D1 . . . Dm can be set not only high or low, but also to intermediate values.

Figure 1:
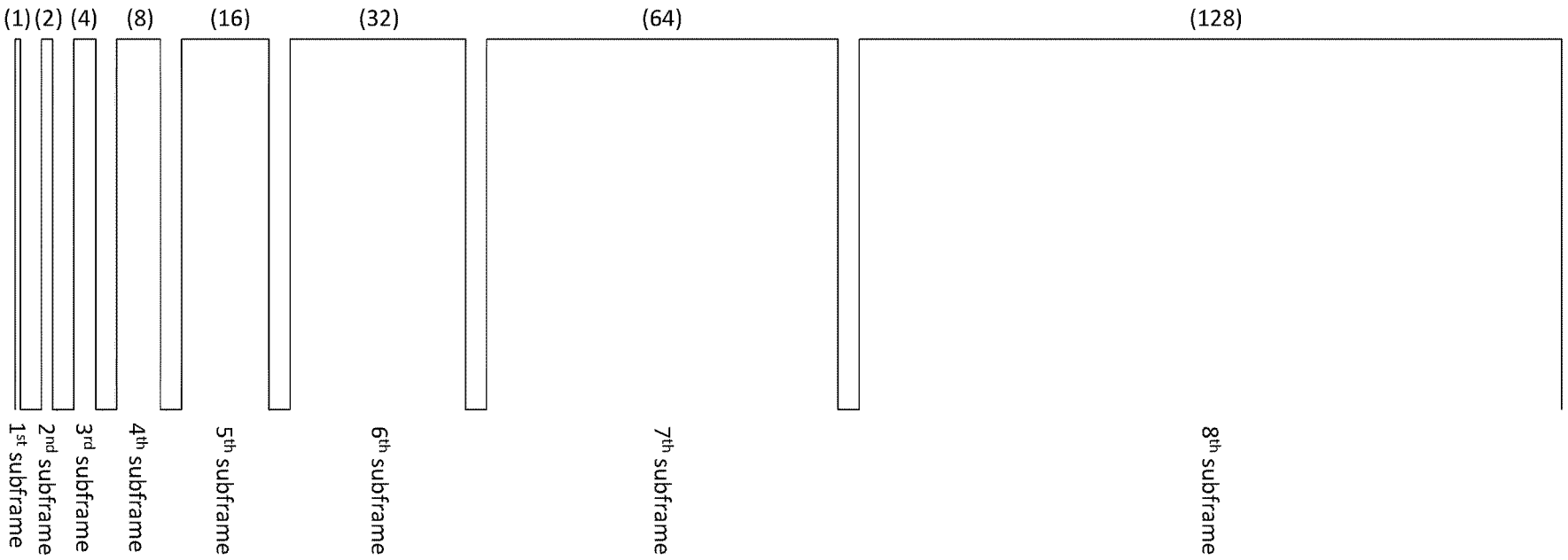
Figure 1 (Prior Art)
FIG. 1 illustrates a conventional PWM driving scheme for a display.
Figure 2:
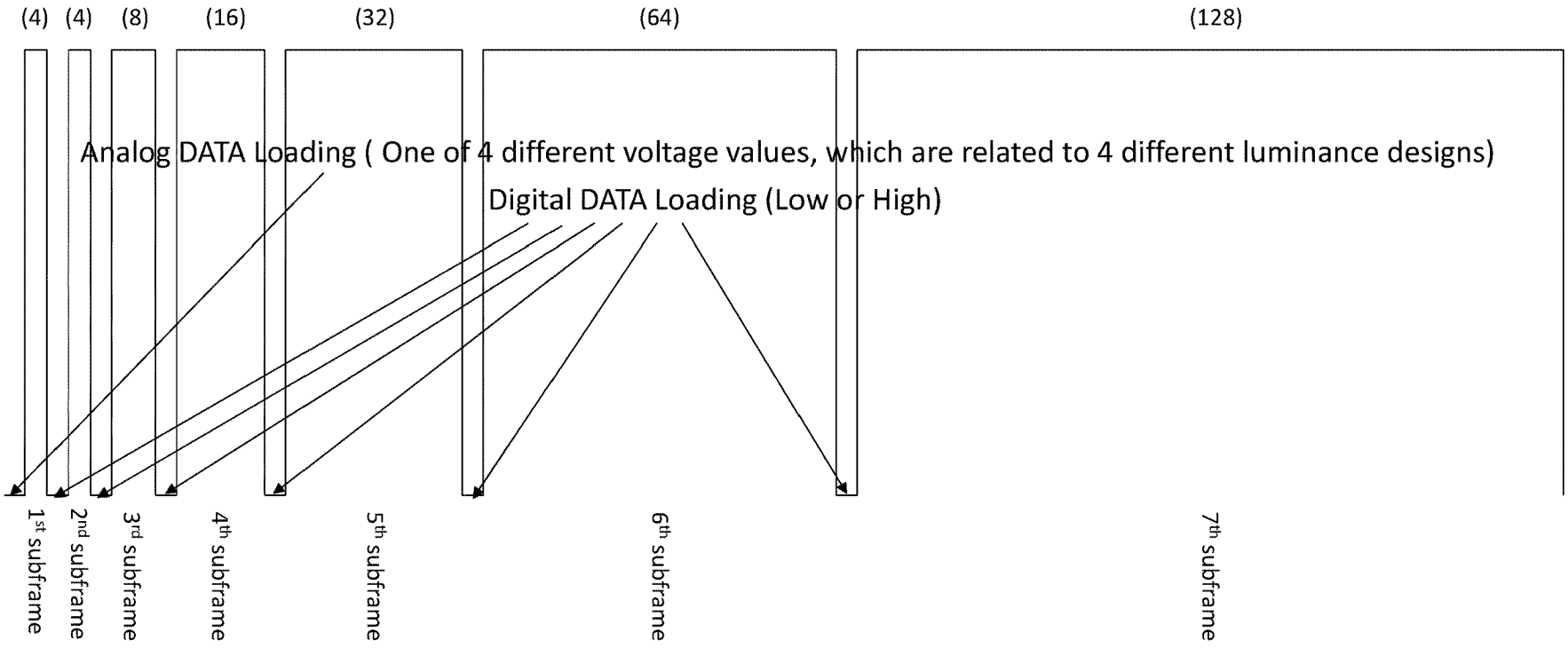
FIG. 2 illustrates a first mixed mode pulse driving scheme for a display according to an embodiment of the present invention.

Referring now to FIG. 2, in one embodiment of a mixed mode driving scheme, 6-bits of an 8-bit grayscale scheme are driven digitally whereas the remaining 2-bits are driven with an analog signal. In the embodiment, the 6 MSBs are driven digitally in a generally conventional fashion, whereas the two LSBs are combined in a single sub-frame—in this case the $1^{st}$ sub-frame. The time duration of the $1^{st}$ sub-frame can be anywhere between the duration of the sub-frame for the least significant digital sub-frame, in this case, the $2^{nd}$ sub-frame, but need not be any shorter than the length of the equivalent sub-frame that would have been required for a digital only driving scheme with a similar frame length. Where for example, the $1^{st}$ analog sub-frame replaces two digital sub-frames, providing the analog sub-frame over the same duration as the $2^{nd}$ sub-frame for the $3^{rd}$ LSB reduces the maximum switching frequency requirement for a frame by 4. On the other hand, reducing the duration by reducing the number of cycles for the first sub-frame towards 1 potentially shortens the overall duration of the frame slightly.

In the example of FIG. 2, a frame is divided into 256 cycles with the MSB PWM pulse being asserted for 128 cycles down to the PWM pulse for $2^{nd}$ sub-frame for the $3^{rd}$ LSB being asserted for 4 cycles. Between each set of PWM pulse cycles, the data driver programs the capacitor for each cell according to whether or not the cell is to be switched on or off for the sub-frame.

In the example of FIG. 2, the $1^{st}$ sub-frame corresponding to the 2 LSB extends over 4 cycles. In this example, an analog value for the cell data signal asserted prior to the analog sub-frame will correspond to one of the gray-levels 0, 1, 2, and 3, and will depend to an extent on the length of the sub-frame. However, for an analog sub-frame with the same duration as the $2^{nd}$ sub-frame, and for a matrix such as shown in FIG. 4 where Vdd=5V, the voltages corresponding to gray-level 0, 1, 2, 3 can be 0V, 3.25V, 4.52V, 4.78V respectively. These voltages can either be provided by DACs incorporated with the DATA driver or through providing fixed reference voltage lines and multiplexors for selecting those lines as required within the DATA driver.

These levels provide a sufficient level of charge to Cst to partially or fully switch on both T2 and the iLED during the analog $1^{st}$ sub-frame (or to switch off T2 for gray level 0) and so provide the finer adjustment of the brightness of the iLED during the frame as a whole.

Using the approach of FIG. 2, one data-loading cycle is saved and one emission sub-frame or up to 3 emission cycles can be saved according to the frequency switching limitations for the matrix.

Figure 3:
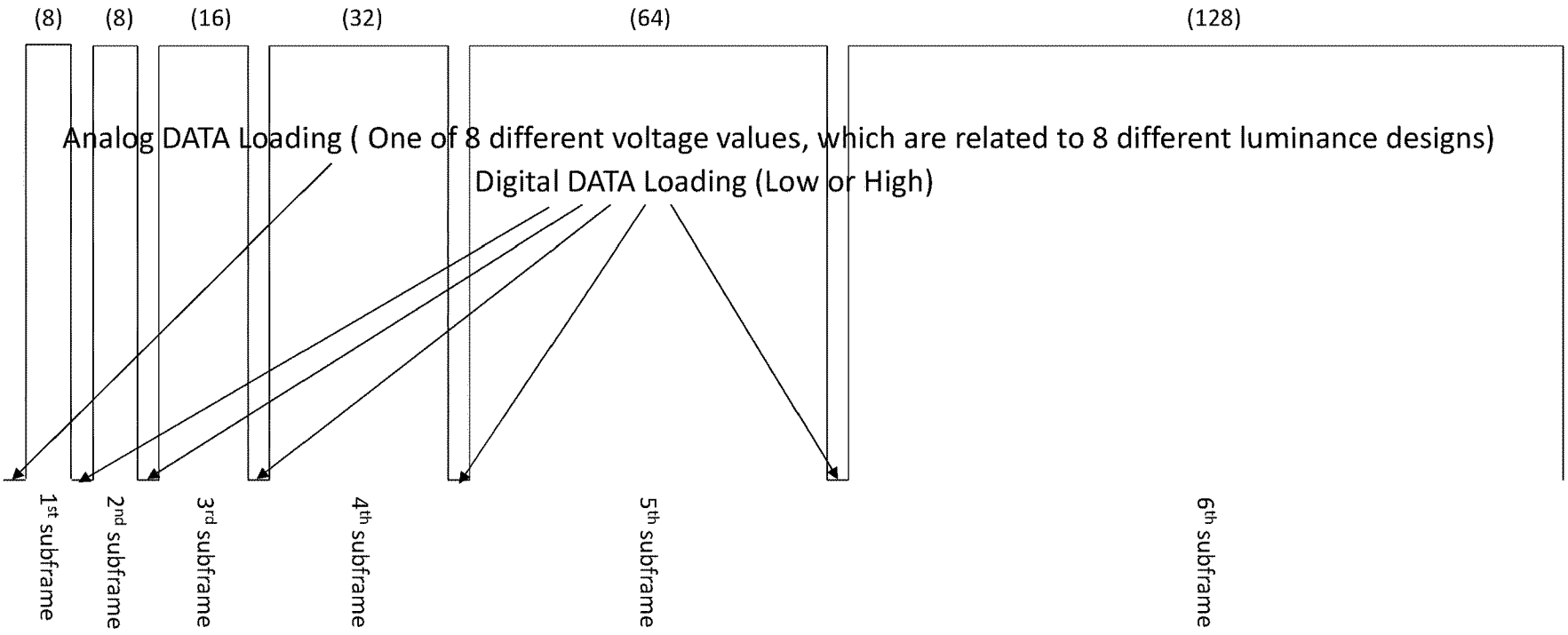
FIG. 3 illustrates a second mixed mode pulse driving scheme for a display according to an embodiment of the present invention.

Other combinations of analog and data sub-frames are also possible. FIG. 3 shows another combination comprising 5 MSB digital sub-frames plus 3 LSB analog sub-frames to achieve 8-bit grayscale. In this case, two data-loading cycles are saved and either two emission sub-frames or up to 7 emission cycles can be saved. This of course requires finer data control of the charge on the capacitor Cst and for example requires 3-bit DACs for each port of the DATA driver, rather than 2-bit DACs as in the example of FIG. 2. However, the approach potentially reduces frequency switching requirements even further than the approach of FIG. 2.

In either case, it will be seen that the matrix only operates in analog mode for a small proportion of its operating cycle, i.e. 4 or 8 emission cycles of 256 cycles and so this provides satisfactory device durability.

It will be appreciated that using the architecture of FIG. 4, 5 or 6, the number of analog sub-frames and number of digital sub-frames can be variable (up to the resolution of the DACs or available reference voltages employed within the DATA driver) for a given display and can be adjusted for different applications.

Referring back to FIGS. 7(*a*) and 7(*b*), the high supply voltage (Vdd) is the highest voltage of the entire panel while Vss, at ground level, is the lowest one. When PWM pulses are applied to a common high supply line for a row of iLEDs as in the matrices of FIG. 4, their amplitude swing, from Vdd to Vss, is the largest possible. This has a direct impact on the power consumption of the display since more capacitances have to be loaded more often.

In other embodiments, such as FIG. 7(*b*), the PWM signal is instead applied directly to the cathode of the iLED and when asserted, the iLED will emit light or not for the sub-frame according to the charge on Cst. FIG. 6 shows an active matrix incorporating the pixel design of FIG. 7(*b*) and where each cell comprises a red, green or blue sub-pixel of a color display.

The advantage of this approach is that the voltage swing for the PWM pulse can now be reduced compared to the pulses used in the matrix of FIG. 4 resulting in lower power consumption. With a supply voltage Vdd-Vss of between about 10-12V, the voltage needed to turn OFF the iLED device is about 4-5V. So rather than driving the PWM signal between Vdd and Vss, using the pixel design of FIG. 7(*b*) and the matrix of FIG. 6, when the PWM pulse is high (Vdd>~5V>Vss), the ILED is OFF and when it is "0"=Vss, the iLED emits light according to the charge on capacitor Cst. This pixel design not alone results in less power consumption but also reduced propagation delay vis-à-vis a matrix using the pixel design of FIG. 4, because the PWM signal is applied directly to the iLED cathode.

Figure 8A:
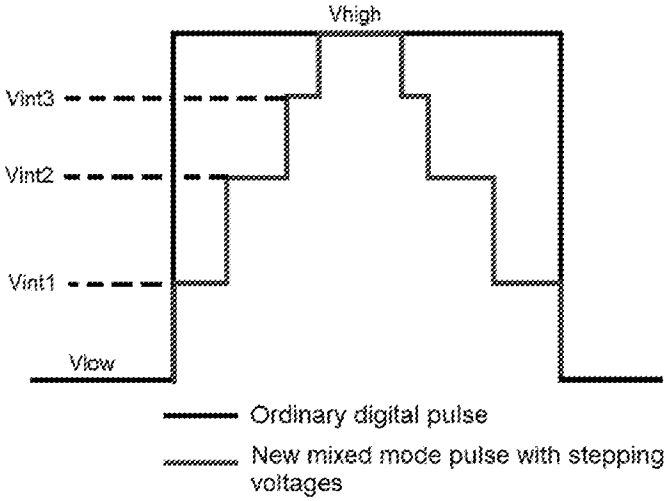
FIGS. 8(*a*) and 8(*b*) illustrate stepped versions of the driving pulses for the matrices of FIGS. 4, 5 and FIG. 6 respectively.
Figure 8B:
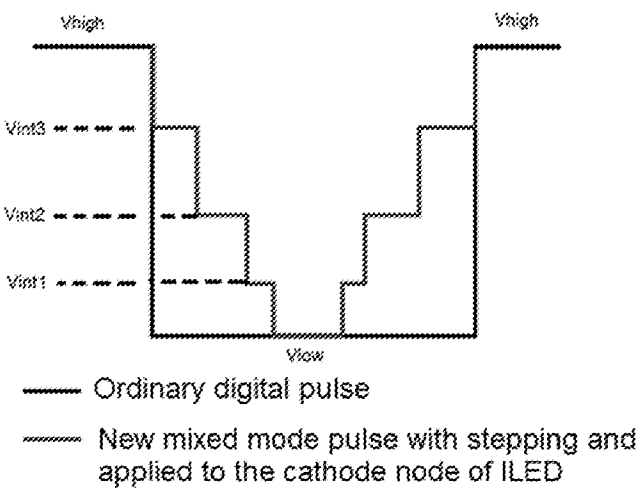

To further reduce the power consumption, instead of a digital two-level voltage swing for the PWM signals, a stepped multi-voltage level PWM pulse can be applied as shown in FIG. 8. FIG. 8(*a*) shows such a stepping pulse applied at the high power supply line as in the matrices of FIGS. 4 and 5; whereas FIG. 8(*b*) illustrates a stepping pulse employed with the pixel design of FIG. 7(*b*) and with the matrix of FIG. 6.

The main advantage of the voltage stepping pulse is lower power consumption (theoretically it can reach −33%) because the extent of the PWM pulse swing is reduced. Furthermore, the transition of the iLED from the ON to the OFF state will be smoother, so reducing visual artefacts. The number of the intermedia voltage levels (Vint1 . . . Vint3) and their time duration is determined based on the display's specifications and the required performance as well as the mixed mode pulse waveform. Again, these intermediate voltages can either be provided by DACs incorporated with the PWM driver or through providing fixed reference voltage lines and multiplexors for selecting those lines as required within the PWM driver.

The above embodiments have been described with successively longer sub-frames within any given frame. However, it will be appreciated that sub-frames need not be ordered as such and can be mixed to avoid visual aliasing artefacts.

It will also been seen that embodiments of the invention can comprise more than 1 analog sub-frame.

The invention claimed is:

1. A display, comprising:

a matrix comprising a plurality of rows divided into a plurality of columns of cells, each cell including a light emitting device;

a scan driver providing a plurality of scan line signals to respective rows of the matrix, each for selecting a respective row of the matrix to be programmed with pixel values;

a data driver providing a plurality of variable level data signals to respective columns of the matrix, each for programming a respective pixel within a selected row of the matrix with a pixel value; and a pulse driver providing a plurality of driving signals to respective rows of the matrix, each driving signal comprising a sequence of driving pulses enabling the cells to emit light according to their programmed pixel values during respective sub-frames of successive frames to be displayed, wherein each driving pulse of the sequence of driving pulses comprises a stepped pulse with multiple intermediate voltage levels, the stepped pulse including increasing voltage levels from a first intermediate voltage level followed by decreasing voltage levels to the first intermediate voltage level or decreasing voltage levels from a second intermediate voltage level followed by increasing voltage levels to the second intermediate voltage level;

wherein the data driver is configured to provide the variable level data signals to respective pixels within a selected row of the matrix during a limited number of sub-frames of a frame, variable data levels of the variable level data signals each being defined by a programmed gray-level value of a plurality of bits of a pixel value for the frame, and wherein the data driver is configured to provide data signals to the respective pixels within the selected row of the matrix during a remaining number of sub-frames of the frame, data levels of the data signals each being defined by a programmed value of a single bit of the pixel value for the frame, and wherein each stepped pulse of the sequence of driving pulses corresponds with the limited number of sub-frames of the frame or a sub-frame of the remaining number of sub-frames of the frame.

2. The display according to claim 1, wherein each pixel is programmed according to a grayscale value and wherein the frame includes a number of sub-frames that is less than a number of gray-scale bits of the frame.

3. The display according to claim 1, wherein the limited number of sub-frames comprises a single sub-frame.

4. The display according to claim 1, wherein the limited number of sub-frames correspond with the least significant bits (LSB) of the pixel value for the frame.

5. The display according to claim 1, wherein the limited number of sub-frames correspond with either 2 or 3 least significant bits (LSB) of the pixel value for the frame.

6. The display according to claim 1, wherein a sub-frame corresponding to a most-significant bit (MSB) of the pixel value for the frame has a longest sub-frame duration and a sub-frame corresponding to a least-significant bits of the pixel value for the frame has a shortest sub-frame duration.

7. The display of claim 1, wherein the limited number of sub-frames are variable according to a maximum resolution of the variable level data signals provided by the data driver.

8. The display of claim 1, wherein each cell comprises a first transistor connected to each of a scan driver signal line and a data driver signal line, the first transistor being connected to a second transistor, the second transistor being connected in series with a light emitting device, and a charge storage device connected between the first and second transistors, the scan driver signal line periodically actuating the first transistor to enable the data driver signal line to set a charge on the charge storage device for a subsequent sub-frame.

9. The display of claim 8, wherein a source for each second transistor of a row is connected in common to a pulse driving signal for the row.

10. The display of claim 8, wherein each light emitting device is connected between the pulse driving signal for the row and a source for the second transistor.

11. The display of claim 8, wherein each light emitting device is connected between the pulse driving signal for the row and a drain for the second transistor and wherein the source for each second transistor is connected to a common supply line.

12. The display of claim 11, wherein an amplitude of the driving pulses is less than the voltage of the common supply line.

13. The display of claim 1, wherein the light emitting devices comprise an inorganic light emitting diode (LED).

14. The display of claim 1, wherein a duration of the limited number of sub-frames is no greater than a shortest duration of a sub-frame from the remaining number of sub-frames.

15. The display of claim 1, wherein a duration of the limited number of sub-frames is approximately equal to a shortest duration of a sub-frame from the remaining number of sub-frames.

16. A display, comprising:

a matrix comprising a plurality of rows divided into a plurality of columns of cells, each cell including a light emitting device;

a scan driver configured to provide a plurality of scan line signals to respective rows of the matrix, each for selecting a respective row of the matrix to be programmed with pixel values;

a data driver configured to provide a plurality of variable level data signals to respective columns of the matrix, each for programming a respective pixel within a selected row of the matrix with a pixel value; and a pulse driver configured to provide a plurality of driving signals to respective rows of the matrix, each driving signal comprising a sequence of driving pulses enabling the cells to emit light according to their programmed pixel values during respective sub-frames of successive frames to be displayed;

wherein each driving pulse of the sequence of driving pulses comprises a stepped pulse with multiple intermediate voltage levels, the stepped pulse including increasing voltage levels from a first intermediate voltage level followed by decreasing voltage levels to the first intermediate voltage level or decreasing voltage levels from a second intermediate voltage level followed by increasing voltage levels to the second intermediate voltage level;

wherein the data driver is configured to provide the variable level data signals to respective pixels within a selected row of the matrix during a limited number of sub-frames of a frame, variable data levels of the variable level data signals each being defined by a programmed gray-level value of a plurality of bits of a pixel value for the frame, and wherein the data driver is configured to provide data signals to the respective pixels within the selected row of the matrix during a remaining number of sub-frames of the frame, data levels of the data signals each being defined by a programmed value of a single bit of the pixel value for the frame; and wherein each stepped pulse of the sequence of driving pulses corresponds with the limited number of sub-frames of the frame or a sub-frame of the remaining number of sub-frames of the frame.

17. The display according to claim 16, wherein each cell comprises a first transistor connected to each of a scan driver signal line and a data driver signal line, the first transistor being connected to a second transistor, the second transistor being connected in series with a light emitting device, and a charge storage device connected between the first and second transistors, the scan driver signal line periodically actuating the first transistor to enable the data driver signal line to set a charge on the charge storage device for a subsequent sub-frame.

18. A display, comprising:

a plurality of cells, each cell including a light emitting device;

a data driver configured to provide variable level data signals to a matrix during a first sub-frame of a frame and provide data signals to the matrix during a second sub-frame of the frame, variable data levels of the variable level data signals of the first sub-frame each being defined by a programmed gray-level value of a plurality of bits of a pixel value for the frame, data levels of the data signals of the second sub-frame each being defined by a programmed value of a single bit of the pixel value for the frame; and a pulse driver configured to provide driving signals including a sequence of driving pulses to the matrix to enable the cells to emit light according to the variable level data signals during the first sub-frame and emit light according to the data signals during the second sub-frame, wherein each driving pulse of the sequence of driving pulses comprises a stepped pulse with multiple intermediate voltage levels, the stepped pulse including increasing voltage levels from a first intermediate voltage level followed by decreasing voltage levels to the first intermediate voltage level or decreasing voltage levels from a second intermediate voltage level followed by increasing voltage levels to the second intermediate voltage level.

* * * * *